US010827257B2

(12) United States Patent
Sun et al.

(10) Patent No.: US 10,827,257 B2
(45) Date of Patent: Nov. 3, 2020

(54) IN-VEHICLE AUDIO SYSTEM

(71) Applicant: AAC Technologies Pte. Ltd., Singapore (SG)

(72) Inventors: Shuyuan Sun, Shenzhen (CN); Hao Yin, Shenzhen (CN); Rongguan Zhou, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/528,643

(22) Filed: Aug. 1, 2019

(65) Prior Publication Data

US 2020/0053455 A1 Feb. 13, 2020

(30) Foreign Application Priority Data

Aug. 9, 2018 (CN) ..... 2018 1 0902970

(51) Int. Cl.
*H04R 1/34* (2006.01)
*H04R 1/02* (2006.01)

(52) U.S. Cl.
CPC ..... *H04R 1/345* (2013.01); *H04R 1/025* (2013.01); *H04R 2499/13* (2013.01)

(58) Field of Classification Search
CPC ..... H04R 2499/13; H04R 1/025; H04R 1/345
USPC ..... 381/86
See application file for complete search history.

(56) References Cited

U.S. PATENT DOCUMENTS 8,264,856 B2 * 9/2012 Snider ..... H04B 1/082 361/818

FOREIGN PATENT DOCUMENTS

CN 108271107 A1 7/2018

OTHER PUBLICATIONS

1st Office Action dated Jul. 30, 2019 by SIPO in related Chinese Patent Application No. 201810902970.9 (8 Pages).

* cited by examiner

*Primary Examiner* — Paul Kim
(74) *Attorney, Agent, or Firm* — W&G Law Group LLP

(57) ABSTRACT

An in-vehicle audio system, including a sounding module mounted inside a vehicle. The sounding module includes a housing having receiving space, and a sounding unit mounted in the receiving space. The sounding unit divides the receiving space into a back coupling cavity and a front sounding cavity. The housing includes a body fixing the sounding unit, and an upper cover plate and a lower cover plate mounted at two sides of the body. The back coupling cavity is formed between the lower cover plate and the body. The front sounding cavity is formed between the upper cover plate and the body. The sounding side of the sounding unit is facing toward the upper cover plate. The side wall of the body is provided with a side sounding outlet communicated with the front sounding cavity. The side sounding outlet is facing toward the interior of the vehicle.

8 Claims, 11 Drawing Sheets

2

200

3

3

4

4

IN-VEHICLE AUDIO SYSTEM

TECHNICAL FIELD

The present disclosure relates to the field of automobiles, and in particular, to an in-vehicle audio system.

BACKGROUND

With the rapid development of automotive electronic technology, in-vehicle entertainment and information communication are gradually gained attention by people. An in-vehicle audio system plays a key role as an important part of in-vehicle entertainment and information communication system.

In the related art, the sounding module of the in-vehicle audio system has a thick thickness, and a larger space behind a sounding outlet is required to mount the sounding module, therefore, the position where the sounding module can be arranged is limited, and the sounding module can only be arranged in vehicle doors, lower ends of A-pillars and upper surfaces of a central console and the like, resulting in inflexible arrangement modes. Moreover, the sounding modules of the in-vehicle audio systems in the related art are all in the form of front sounding and all need to be provided with a sounding net cover, so that in a user visible area of an interior trim of the vehicle, a large area needs to be mounted with the net cover, which destroys the integrity of the interior trim, resulting in an unattractive design of the interior trim, affecting the user experience. Meanwhile, in the related art, the diaphragm of the sounding module has a large radiation area, which requires that the shape of a sounding hole is similar to the shape of the radiation surface of the sounding module, and that the area of the sounding hole is also similar to the area of the radiation surface of the sounding module, resulting in a further limited mounting position. Therefore, most of the sounding modules in the related art can only be mounted in the vehicle doors or on the upper surfaces of the central console and the like, while retaining the visible sounding hole will affect the visual effect of the overall interior design. In addition, the sounding module in the related art increases the influence on the vibration of a vehicle body by using a vehicle body interlayer as a back coupling cavity of a sounding module unit.

Therefore, it is necessary to provide a novel in-vehicle audio system to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Embodiment 1

Figure 1:
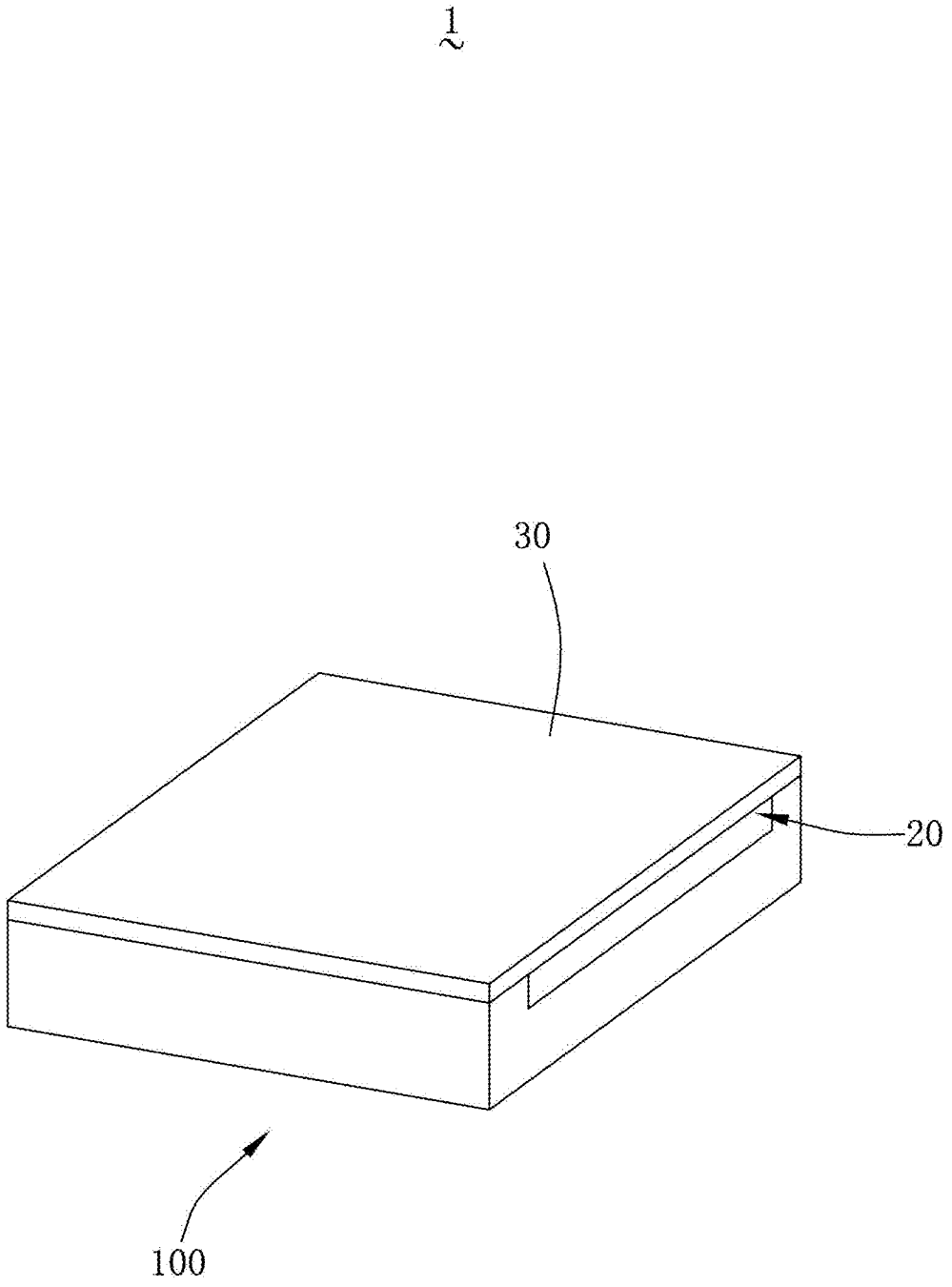
FIG. 1 is a perspective structural schematic diagram of an in-vehicle audio system according to Embodiment 1 of the present disclosure.
Figure 2:
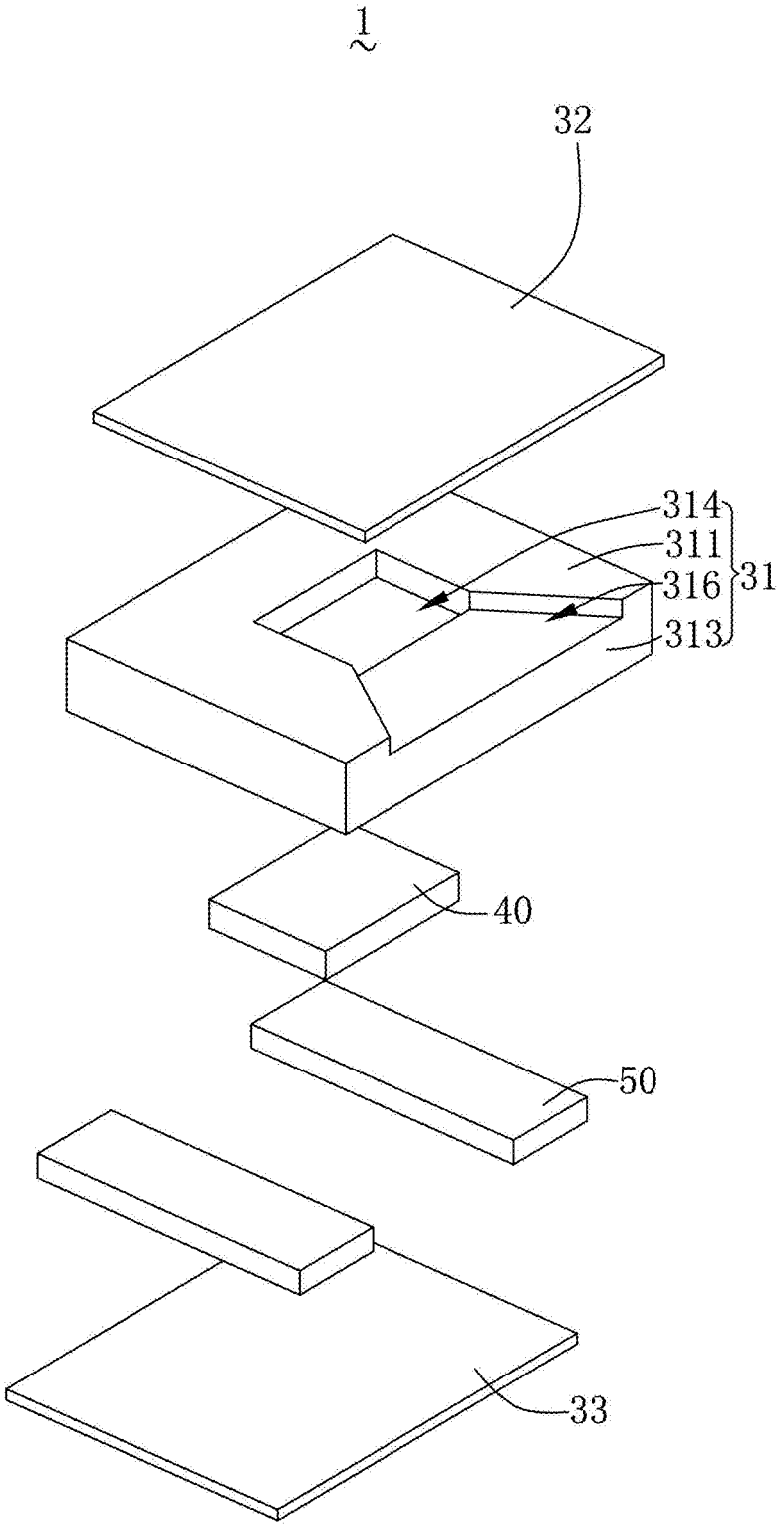
FIG. 2 is an exploded structural schematic diagram of the in-vehicle audio system according to Embodiment 1 of the present disclosure.
Figure 3:
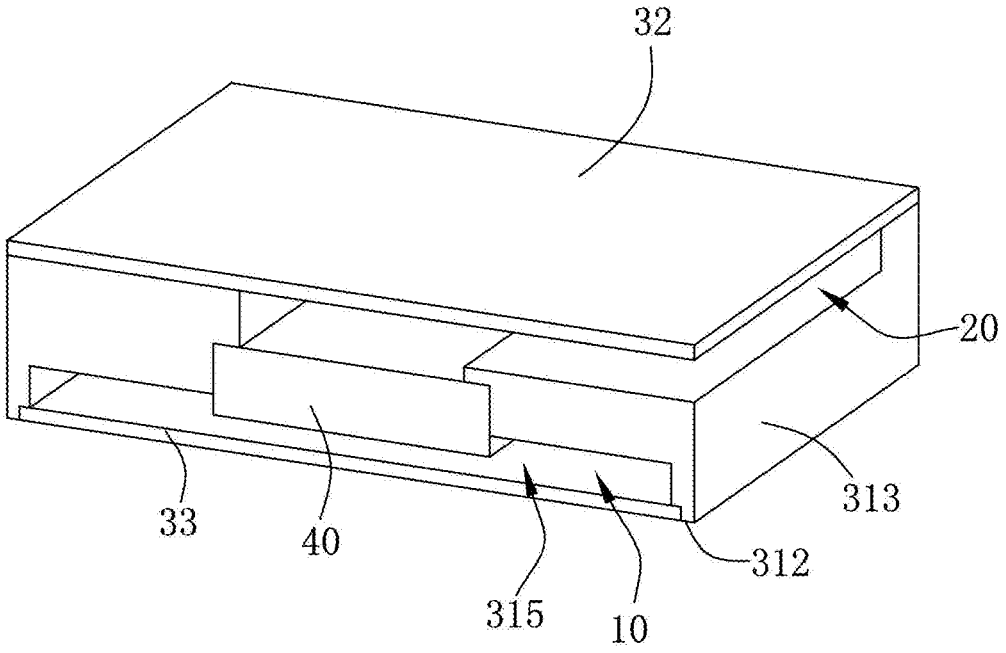
FIG. 3 is a cross-sectional structural schematic diagram of the in-vehicle audio system according to Embodiment 1 of the present disclosure.

With reference to FIG. 1 to FIG. 3, the present disclosure provides an in-vehicle audio system 1, including a sounding module 100 mounted in a vehicle. The sounding module 100 includes a housing 30 having a receiving space, and a sounding unit 40 and a filling material 50 that are mounted in the receiving space. The sounding unit 40 divides the receiving space into a back coupling cavity 10 and a front sounding cavity 20.

The housing 30 includes a body 31 fixing the sounding unit 40, and an upper cover plate 32 and a lower cover plate 33 that are mounted at two sides of the body 31. The front sounding cavity 20 is formed by the upper cover plate 32 and the body 31, and the back coupling cavity 10 is formed by the lower cover plate 33 and the body 31. The sounding side of the sounding unit 40 is facing toward the upper cover plate 32, the side wall of the body 31 is provided with a side sounding outlet communicated with the front sounding cavity 20, and the direction of the side sounding outlet is facing toward the interior of the vehicle.

The body 31 includes an upper surface 311 close to one side of the upper cover plate 32, a lower surface 312 close to one side of the lower cover plate 33, a side surface 313 connecting the upper surface 311 with the lower surface 312, a mounting hole 314 penetrating through the body 31 along the upper surface 311 towards the lower surface 312, a groove 315 formed by recessing from the lower surface 312 towards the upper surface 311, and a sound guiding groove 316 formed by recessing from the upper surface 311 towards the lower surface 312. The sound guiding groove 316 extends to the side surface 313 to form the side sounding outlet.

The sounding unit 40 is mounted in the mounting hole 314, and the groove 315 and the sound guiding groove 316 are both communicated with the mounting hole 314. For example, the orthographic projection of the mounting hole 314 on the groove 315 completely falls within the groove 315, and the mounting hole 314 is located on the same straight line as the central axis of the groove 315. The sound guiding groove 316 communicates the mounting hole 314 with the side surface 313, and the cross-sectional area of the sound guiding groove 316 gradually increases towards the side surface 313.

The upper cover plate 32 covers and is connected to the upper surface 311 and cooperates with the body 31 to enclose the sound guiding groove 316 to form the front sounding cavity 20. Since the sound guiding groove 316 communicates the mounting hole 314 with the side surface 313, the upper cover plate 32 covers and is connected to the upper surface 311 to enclose the front sounding cavity 20 to form a side sounding structure. A sounding outlet, located at one side of the side surface 313, of the front sounding cavity 20 may be in any desired shape. For example, the shape of the sounding outlet of the front sounding cavity 20 is consistent with the shape of the mounting position, so as to be invisible. If mounted in an air outlet of an in-vehicle air conditioner, the sounding outlet of the front sounding cavity 20 is consistent in shape with the air outlet of the air conditioner, so as to be invisible and to better facilitate the integrity of the interior trim of the vehicle. In the present embodiment, the sounding outlet, located at one side of the side surface 313, of the front sounding cavity 20 is in a rectangular shape. Meanwhile, since the cross-sectional area of the sound guiding groove 316 gradually increases from the mounting hole 314 towards the side surface 313, the sounding outlet of the front sounding cavity 20 can be designed to be as thinner as possible, thereby weakening the visibility of the sounding outlet of the front sounding cavity 20, so that a user cannot obviously see it.

The lower cover plate 33 covers and is connected to the lower surface 312 and cooperates with the body 31 to enclose the groove 315 to form the back coupling cavity 10.

It can be understood that the structural design of the back coupling cavity 10 is adopted, which can reduce the vibration impact on the vehicle body while ensuring the sound quality. In the related art, since the sounding module adopts front sounding and the sounding net cover needs to be mounted at the sounding outlet, a larger area is needed to mount the sounding net cover in the visible area of a user in the vehicle, which destroys the integrity of the interior trim of the vehicle and affects the user experience. Meanwhile, in the related art, there is a larger space to mount the sounding unit behind the sounding outlet, thus causing the sounding module in the related art to be so large that there is limited position for mounting the sounding module. While in the present disclosure, the sounding unit 40 is mounted on the back coupling cavity 10 and forms a side sounding structure through the front sounding cavity 20, so that the volume of space occupied by the sounding module 100 is reduced, and the defects of limited mounting position due to the large volume of the sounding module in the related art can be overcome, and thus the sounding module 100 can have more mounting positions.

For example, the sounding unit 40 and the back coupling cavity 10 are mounted in an external-mounted manner, a back-mounted manner, or an embedded manner, that is, the sounding unit 40 may be completely or partially embedded in the back coupling cavity 10, or can also be arranged side by side and oppositely with the back coupling cavity 10, which is feasible as long as it can be coupled with the back coupling cavity 10.

The filling material 50 is arranged in the back coupling cavity 10 and configured to enlarge the acoustic equivalent volume of the back cavity. In the present embodiment, the filling material 50 is arranged in the form of a filling package, there are two filling packages and the two filling packages are spaced apart from each other and arranged symmetrically with respect to the sounding unit 40. It is appreciated that, in other embodiments, the filling package may also be arranged in other positions, or the filling package may not be arranged, and thus it is also feasible that the filling material 50 is filled in the back coupling cavity 10 in a form of powder.

Embodiment 2

Figure 4:
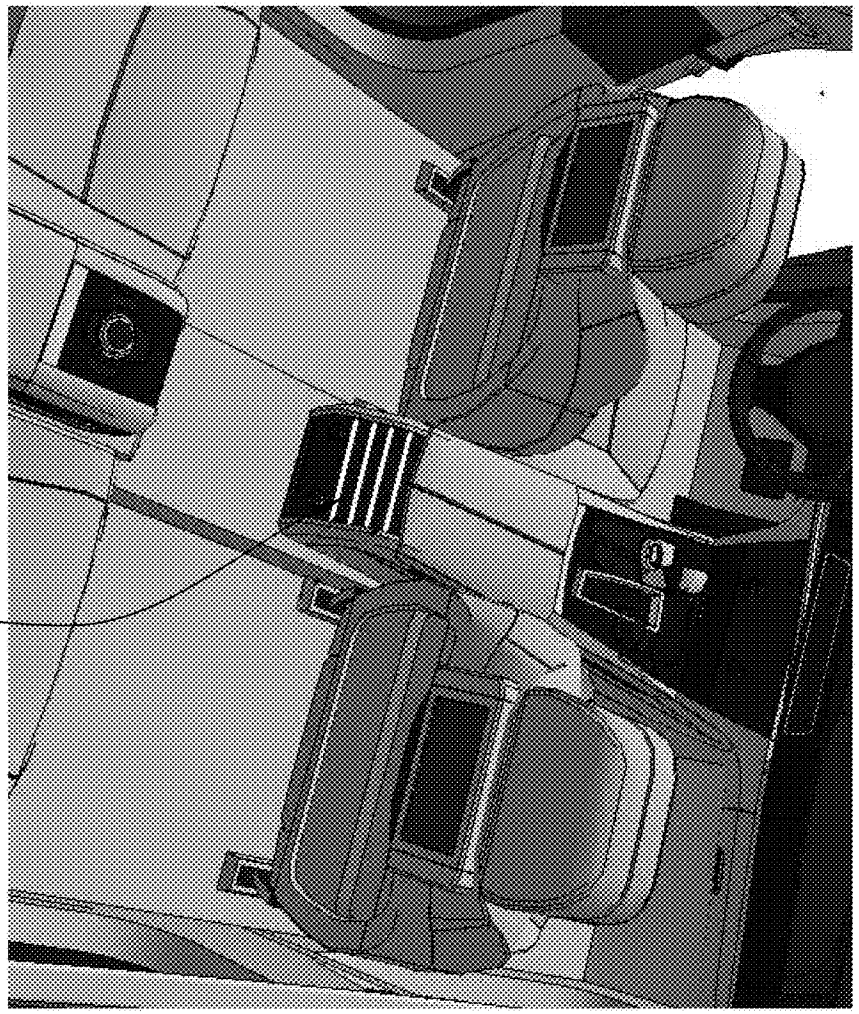
FIG. 4 is a structural schematic diagram of an in-vehicle audio system according to Embodiment 2 of the present disclosure.
Figure 5:
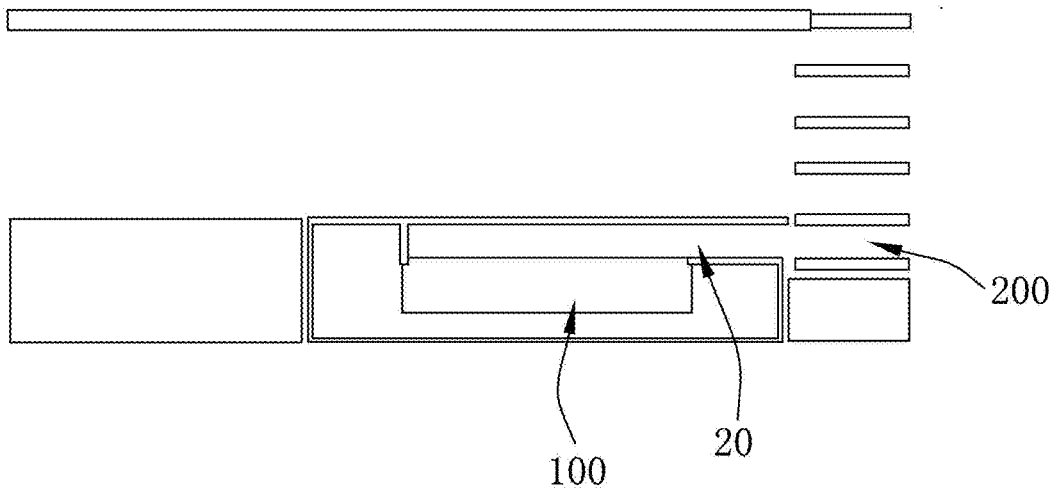
FIG. 5 is an internal structural schematic diagram of the in-vehicle audio system as shown in FIG. 4.

With reference to FIG. 4 and FIG. 5, in the present embodiment, an in-vehicle audio system 2 includes a sounding module 100 mounted in the vehicle, and an in-vehicle air conditioner 200. The sounding module 100 is arranged at the air outlet of the in-vehicle air conditioner 200, and the direction of the sounding outlet of the sounding module 100 is the same as the direction of the air outlet of the in-vehicle air conditioner 200. For example, the sounding outlet of the front sounding cavity 20 of the sounding module 100 is similar to the shape of the air outlet of the in-vehicle air conditioner 200, the sounding module 100 is shielded by air guides of the in-vehicle air conditioner 200, and the opening direction of the front sounding cavity 20 is the same as the air outlet direction of the in-vehicle air conditioner 200, thereby achieving the effect of hiding the sounding module 100 behind the in-vehicle air conditioner 200, and then better facilitating the integrity of the interior trim of the vehicle.

Embodiment 3

Figure 6:
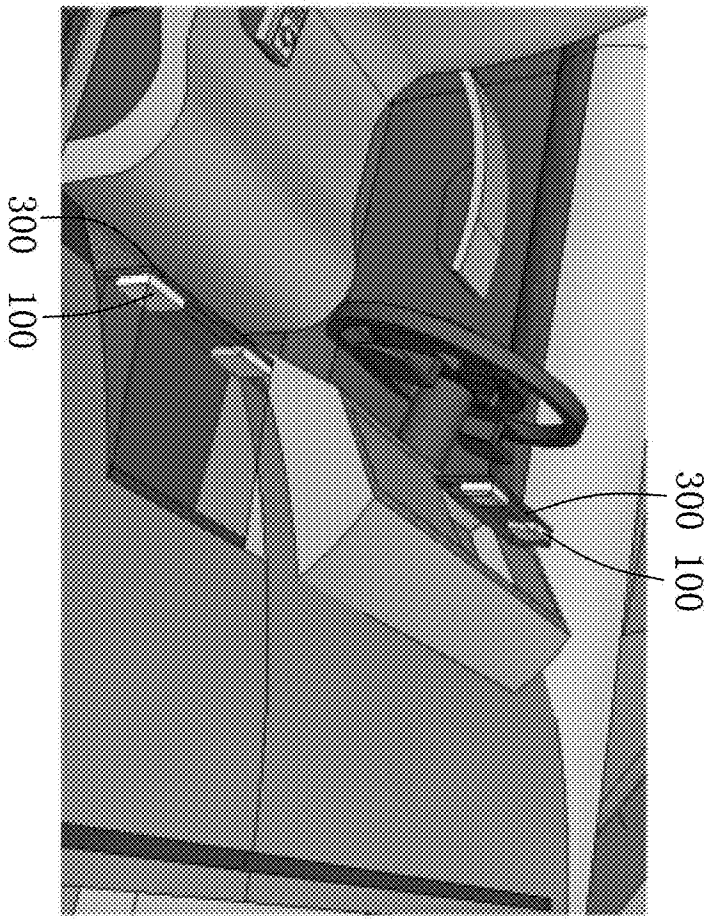
FIG. 6 is a structural schematic diagram of an in-vehicle audio system according to Embodiment 3 of the present disclosure.
Figure 7:
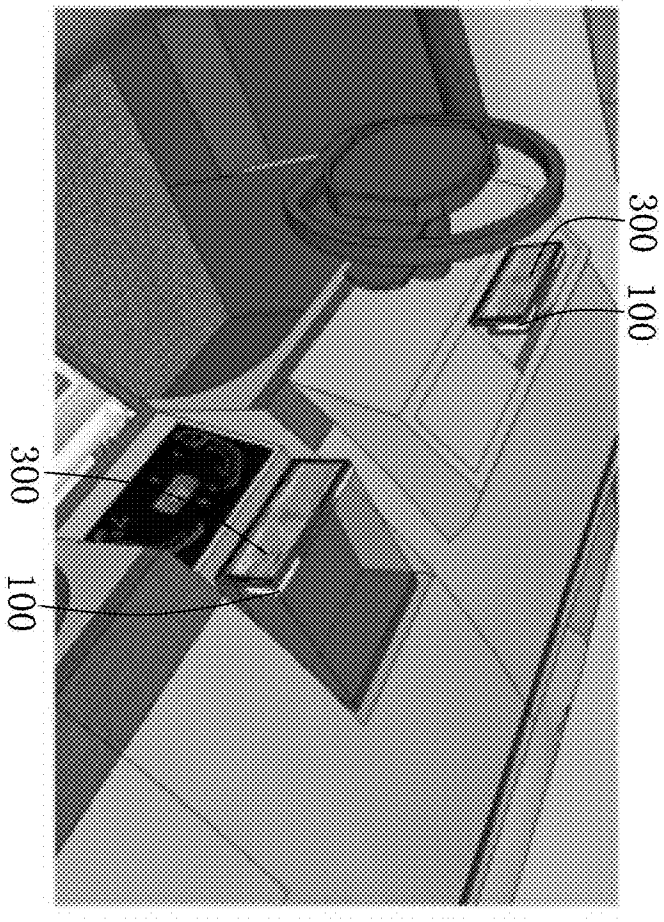
FIG. 7 is a structural schematic diagram of the in-vehicle audio system as shown in FIG. 6 viewing from another perspective.
Figure 8:
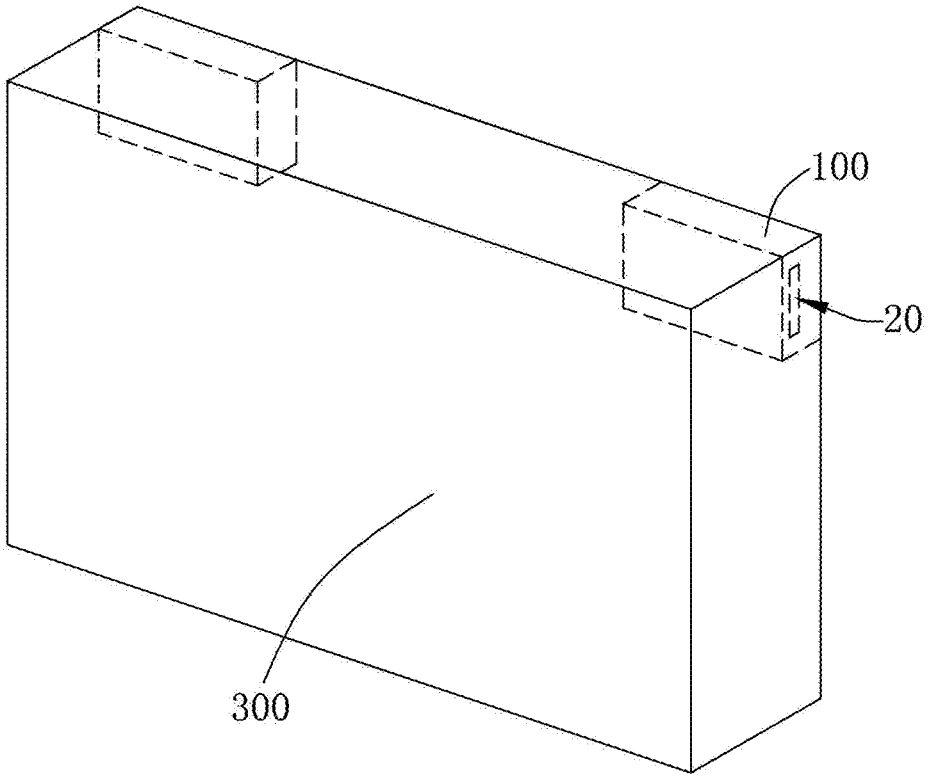
FIG. 8 is an internal structural schematic diagram of the in-vehicle audio system as shown in FIG. 6.

With reference to FIG. 6 to FIG. 8, in the present embodiment, an in-vehicle audio system 3 includes a sounding module 100 mounted in the vehicle, a center console, and a display 300 connected to the center console. The sounding module 100 is mounted at the back side of the display 300, and the direction of the sounding outlet of the sounding module 100 is vertical to the display direction of the display 300. For example, the opening direction of the sounding outlet of the front sounding cavity 20 of the sounding module 100 is located at a side edge of the display 300, and the sounding module 100 is shielded by the display 300, thereby achieving the effect of hiding the sounding module 100 behind the display 300, and then better facilitating the integrity of the interior trim of the vehicle.

Embodiment 4

Figure 9:
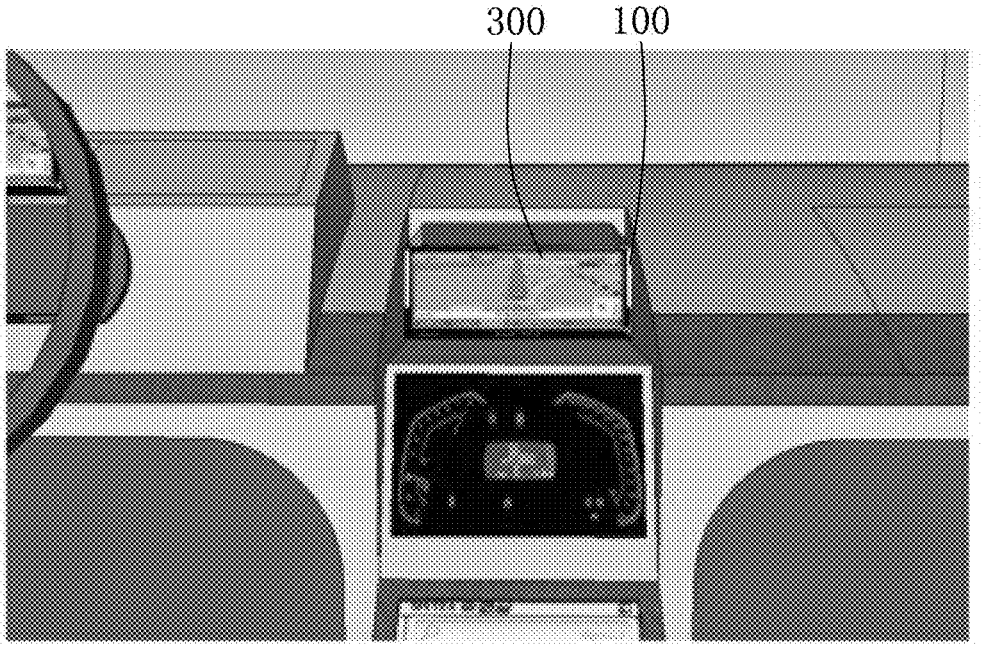
FIG. 9 is a structural schematic diagram of an in-vehicle audio system according to Embodiment 4 of the present disclosure.
Figure 10:
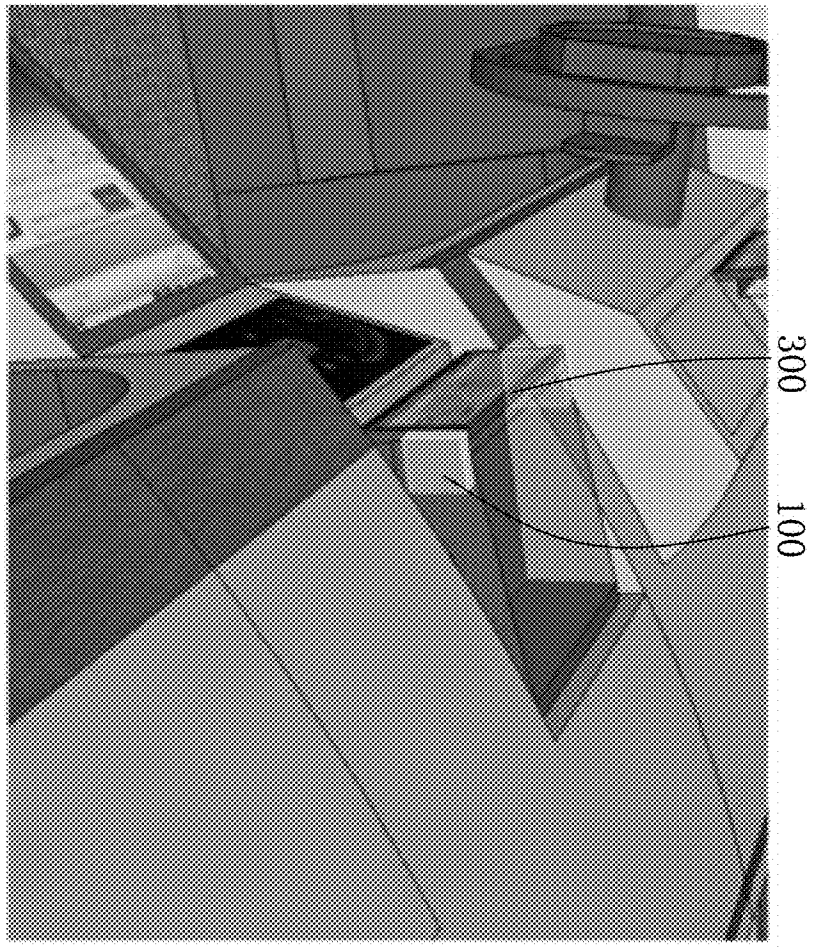
FIG. 10 is a structural schematic diagram of the in-vehicle audio system as shown in FIG. 9 viewing from another perspective.
Figure 11:
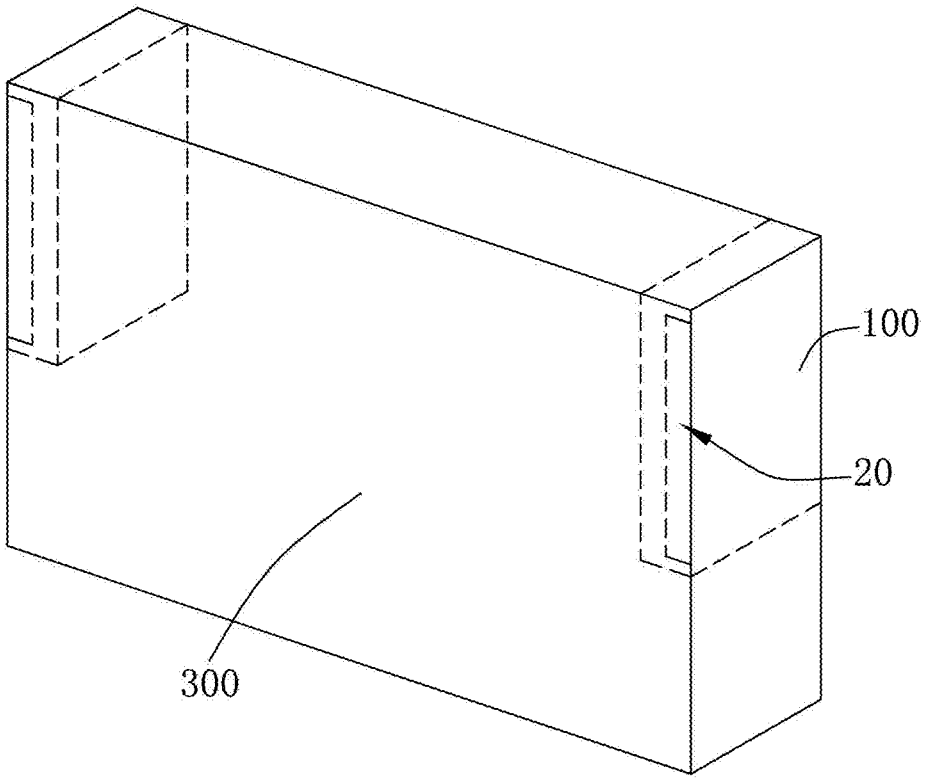
FIG. 11 is an internal structural schematic diagram of the in-vehicle audio system as shown in FIG. 9.

With reference to FIG. 9 to FIG. 11, in the present embodiment, an in-vehicle audio system 4 includes a sounding module 100 mounted in the vehicle, a center console, and a display 300 connected to the center console. The sounding module 100 is mounted at a side edge of the display 300, and the direction of the sounding outlet of the sounding module 100 is the same as the display direction of the display 300. For example, the sounding module 100 is arranged at the left and right sides of the display 300 (the left and right sides refer to the direction shown in FIG. 9). The opening direction of the sounding outlet of the front sounding cavity 20 of the sounding module 100 is the same as the display direction of the display 300.

It can be understood that the size of the sounding outlet of the front sounding cavity 20 is much smaller than the size of the display 300, thereby weakening the visibility of the sounding outlet of the front sounding cavity 20, and then achieving the effect of the hiding the sounding outlet behind and better facilitating the integrity of the interior trim of the vehicle better. Meanwhile, a dustproof net cover at the sounding outlet of the front sounding cavity 20 can also be consistent with the color of the frame of the display 300, thereby further weakening the visibility of the front sounding cavity 20.

Compared with the related art, the in-vehicle audio system provided by the disclosure adopts the structural design of the back coupling cavity, which can reduce the vibration impact on the vehicle body while ensuring the sound quality. The front sounding cavity is formed by the upper cover plate and the body, and the side wall of the body is provided with the side sounding outlet communicated with the front sounding cavity, so that the volume of space occupied by the sounding module is reduced, thus the sounding module can have more possible mounting positions, and then the invisibility of the sounding module is achieved.

The above are merely the embodiments of the present disclosure, and it should be noted that those skilled in the art can also make improvements, without departing from the creative conception of the present disclosure, which all shall fall within the scope of the present disclosure.

What is claimed is:

1. An in-vehicle audio system, comprising:

a sounding module mounted in a vehicle, the sounding module comprising a housing having a receiving space and a sounding unit mounted in the receiving space, the sounding unit dividing the receiving space into a back coupling cavity and a front sounding cavity, the housing comprising a body fixing the sounding unit, an upper cover plate and a lower cover plate mounted at two sides of the body;

wherein the back coupling cavity is formed between the lower cover plate and the body; the front sounding cavity is formed between the upper cover plate and the body; a sounding side of the sounding unit is facing toward the upper cover plate; the side wall of the body is provided with a side sounding outlet communicating with the front sounding cavity, and the side sounding outlet is facing toward an interior of the vehicle;

wherein the body comprises:

an upper surface close to one side of the upper cover plate;

a lower surface close to one side of the lower cover plate;

a side surface connecting the upper surface with the lower surface; and a mounting hole penetrating through the body along a direction from the upper surface towards the lower surface, wherein the sounding unit is mounted in the mounting hole, and wherein the body further comprises:

a sound guiding groove formed by recessing from the upper surface towards the lower surface, wherein the upper cover plate is connected to and covers the upper surface and cooperates with the body to enclose the sound guiding groove to form the front sounding cavity.

2. The in-vehicle audio system as described in claim 1, wherein the body further comprises: a groove formed by recessing from the lower surface towards the upper surface, wherein the lower cover plate is connected to and covers the lower surface and cooperates with the body to enclose the groove to form the back coupling cavity.

3. The in-vehicle audio system as described in claim 2, wherein the groove is communicated with the mounting hole, and the mounting hole is located on the same straight line as a central axis of the groove.

4. The in-vehicle audio system as described in claim 1, wherein the sound guiding groove extends to the side surface and forms the side sounding outlet in the side surface.

5. The in-vehicle audio system as described in claim 4, wherein a cross-sectional area of the sound guiding groove gradually increases towards the side surface.

6. The in-vehicle audio system as described in claim 1, wherein the vehicle is provided with an in-vehicle air conditioner, the sounding module is arranged at an air outlet of the in-vehicle air conditioner, and a direction of the sounding outlet of the sounding module is the same as a direction of the air outlet of the in-vehicle air conditioner.

7. The in-vehicle audio system as described in claim 1, wherein the vehicle is provided with a center console and a display connected to the center console, the sounding module is arranged at a back side of the display, and a direction of the sounding outlet of the sounding module is perpendicular to a display direction of the display.

8. The in-vehicle audio system as described in claim 1, wherein the vehicle is provided with a center console and a display connected to the center console, the sounding module is mounted on a side edge of the display, and a direction of the sounding outlet of the sounding module is the same as a display direction of the display.

* * * * *